US010907937B1

(12) United States Patent
Keng et al.

(10) Patent No.: US 10,907,937 B1
(45) Date of Patent: Feb. 2, 2021

(54) FIREARM MOUNT AND CLAMP ASSEMBLY

(71) Applicant: Keng's Firearms Specialty, Inc., Atlanta, GA (US)

(72) Inventors: Da Keng, Atlanta, GA (US); Maciej W. Matuszczak, Woodstock, GA (US)

(73) Assignee: Keng's Firearms Specialty, Inc., Atlanta, GA (US)

( * ) Notice: Subject to any disclaimer, the term of this patent is extended or adjusted under 35 U.S.C. 154(b) by 0 days.

(21) Appl. No.: 16/549,277

(22) Filed: Aug. 23, 2019

(51) Int. Cl.
*F41C 27/00* (2006.01)
*F41G 11/00* (2006.01)

(52) U.S. Cl.
CPC ..... *F41G 11/003* (2013.01)

(58) Field of Classification Search
CPC ..... F41C 27/00; F41A 35/00; F41G 1/387; F41G 11/001
See application file for complete search history.

(56) References Cited

U.S. PATENT DOCUMENTS

| | | | | |
|---|---|---|---|---|
| 7,222,451 | B2 | 5/2007 | Keng | |
| 9,038,302 | B1 * | 5/2015 | Pochapsky | F41G 11/001 42/1.06 |
| 9,038,305 | B2 * | 5/2015 | Volfson | F41G 11/003 42/90 |
| 9,332,615 | B1 * | 5/2016 | Peng | H01H 9/0228 |
| 2018/0340754 | A1 * | 11/2018 | Cosentino | F41G 11/003 |

* cited by examiner

*Primary Examiner* — J. Woodrow Eldred

(57) ABSTRACT

A quick disconnect clamping assembly for releaseably attaching an accessory to an elongate support such as a picatinny-style mounting rail comprising a clamp body with a mounting yoke that is adapted to slide over and receive the picatinny rail. The yoke includes a substantially rectangular base plate defining the central upper surface of the clamp body and includes a pair of parallel sidewalls extending upwardly therefrom. A pair of spaced slots formed in the inner surfaces of the sidewalls are adapted to receive a spring and a spring biased positioning ball acts to precisely position the clamping assembly on the mounting rail.

4 Claims, 7 Drawing Sheets

FIREARM MOUNT AND CLAMP ASSEMBLY

BACKGROUND OF THE INVENTION

The present invention relates to a clamp assembly for attaching an accessory to a mounting rail structure affixed to the forearm stock of a firearm. The clamp assembly attaches to the rail structure and enables quick attachment and detachment of the accessory to the firearm without modification of the rail structure or forearm stock.

When shooting firearms, especially in stressful tactical situations, it is important that the firearm be maintained in a steady, stable position to insure accuracy of aim. Most shooters are not able to hold a firearm consistently in a set position without wavering, especially after the onset of fatigue resulting from strain on the shooter due to the size and weight of the firearm. Accordingly, peripheral support devices have been used in conjunction with firearms as a means of stabilizing a firearm to reduce vibration, wavering, etc., and to improve accuracy.

Military and police shooters using military or SWAT rifles often carrying special mounts known as "picatinny" rails under the rifle forearm. Ideally, the attachment should not require extensive modification to the firearm such as machining of the forearm stock of the firearm. Preferably, a mounting device would also enable quick and easy attachment of the accessory to the firearm so that the accessory is held firmly in place without undesirable movement of the accessory relative to the firearm.

BRIEF SUMMARY OF THE INVENTION

The present invention comprises a mounting clamp assembly for mounting an accessory such as a scope or flashlight to a mounting rail structure often affixed below the forearm stock. The mounting block is releasably attachable to a mounting frame by means of a transverse bolt or a similar fastening means.

The base plate of the mounting block is a substantially flat plate having, in one embodiment, first and second rectangular elongate transverse openings or bores formed across the centerline of the rectangular base plate's central upper surface. In a preferred embodiment, first and second substantially rectangular upwardly movable bolts are slidably disposed within the first and second rectangular elongate transverse openings in the rectangular base plate's central upper surface and are controllable or actuable to project upwardly from the yoke base plate's central upper surface.

The yoke base plate sidewalls include inwardly facing V-shaped grooves and are spaced apart. The sidewalls are adapted to fit about and straddle the sides of the picatinny rail mounted to the forearm stock of the firearm with the length of the rail being received between the side walls. The clamp body's first and second transverse bolts, when raised and aligned with the transverse grooves of the picatinny rail, are received in the spaced transverse grooves of the rail to attach the yoke to the rail.

The bolts are actuated by turning an elongate control screw keyed to turn first and second eccentric rotating cam members within the clamp body and beneath the first and second bolts. Each cam preferably bears on a cam-following spring retaining block which includes first and second vertical through bores containing first and second biasing coil springs. Each bolt is preferably configured as a J-shaped member with the cam and spring retaining block disposed within the interior contour of the bolt, such that the cam and spring retaining block can be rotated to urge the cam into an upwardly projecting position, or can be rotated into a position tending to force the bolt downwardly, to lower the bolt such that it does not project above the yoke base plate's central upper surface.

In use, the bolts are initially in the retracted position, such that neither bolt projects above the yoke base plate's central upper surface. Next, the shooter slides the clamp assembly's yoke over the picatinny rail of the firearm and places the clamp assembly in a selected aligned fore/aft position. Next, the clamp body's first and second transverse bolts are raised and are received in and constrained by the spaced transverse grooves of the rail to fixedly attach the yoke to the rail.

The resulting attachment of the clamp assembly to the forearm stock provides a quick and easy attachment of an accessory to the firearm and enables the clamp assembly to mount securely to the forearm stock of the firearm in a stable and secure selected position. This prevents the clamp assembly and thus the accessory carried by the clamp from shifting fore and aft or wobbling during use.

To further stabilize the accessory, a pair of slots are formed on the inner wall of each sidewall and a spring is inserted into each pair of slots so that the springs are disposed in abutting relation with the adjacent rail.

DETAILED DESCRIPTION OF THE INVENTION

Figure 1:
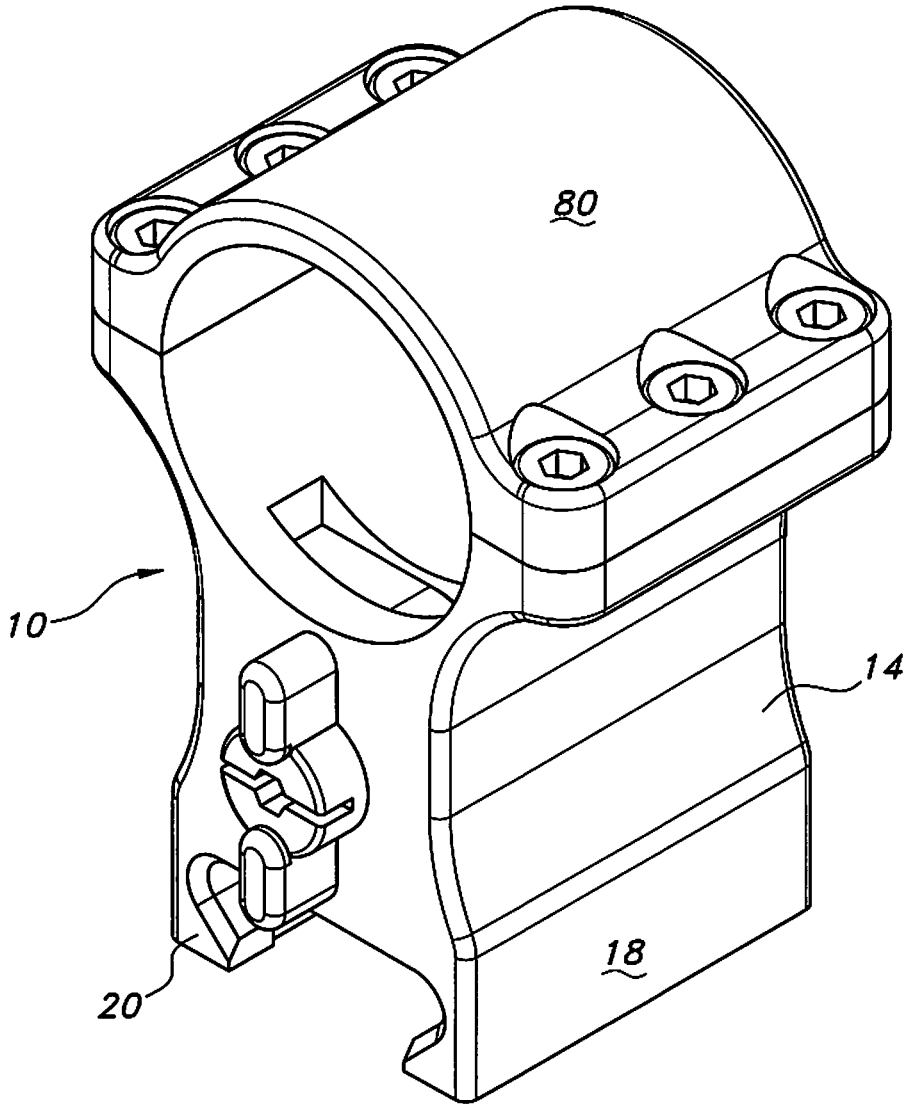
FIG. 1 is a perspective view of the firearm mount and clamp assembly according to this invention.

Referring now to the drawings in which like numerals indicate like parts throughout the several views, this invention comprises a clamp assembly generally indicated by the numeral 10 for mounting an accessory such as a scope, flashlight, bipod or other device or instrument to a firearm. The clamp assembly 10 is generally is mounted to the forearm stock portion of the firearm via an elongate picatinny style mounting rail 50 as typically affixed below and carried on the front end of a rifle's forearm stock.

Mounting rail 50 can be any suitably strong and rigid elongate supporting structure but, in the illustrative embodiment, is a picatinny rail mounting structure having a plurality of evenly spaced standard size transverse grooves. Mounting rail 50 is preferably aligned in parallel with the operational axis of a firearm's barrel.

The accessory mounting device generally comprises clamp assembly 10 with mounting yoke 14 that is adapted to slide over and receive the opposing V-shaped sides of picatinny rail 50. The yoke 14 is releaseably affixed to and hangs from rail 50. The yoke includes a substantially rectangular base plate 16 defining the central upper surface of the clamp body and includes a pair of parallel spaced sidewalls 18, 20 extending upwardly therefrom. The base plate 16 is a substantially flat plate-like surface having, in one embodiment, first and second rectangular elongate transverse openings or bores 22, 24 formed across the centerline of the rectangular base plate's central upper surface. In a preferred embodiment, first and second substantially identical rectangular upwardly movable bolts 26, 28 are slidably disposed within respective first and second substantially identical rectangular elongate transverse openings 22, 24 in the rectangular base plate's central upper surface and are controllable or actuable to project upwardly from the yoke base plate's central upper surface 16.

The yoke base plate sidewalls 18, 20 include inwardly facing V-shaped grooves and are spaced apart and are adapted to slidably retain and straddle the V-shaped sides of picatinny rail 50 mounted to the forearm stock of the firearm with the length of the rail being received between the sidewalls. Mounting picatinny rail 50 is a standard element of the military firearm and normally is used for attaching a variety of accessories including lights, grenade launchers and other devices. The clamp body's first and second transverse bolts 26, 28, when raised and aligned with the transverse grooves of the picatinny rail, are received in the spaced transverse grooves of the rail to affix yoke 14 to the rail.

To facilitate the positioning of yoke 14 on rail 50, generally spherical positioning ball 92 is disposed in bore 94 and is biased upwardly by means of springs 96.

Bolts 26, 28 are actuated by turning an elongate control screw 30 around its own central axis. Control screw 30 is keyed to turn first and second substantially identical eccentric rotating cam members 32, 34 within the clamp body and beneath the first and second bolts 26, 28.

Figure 2:
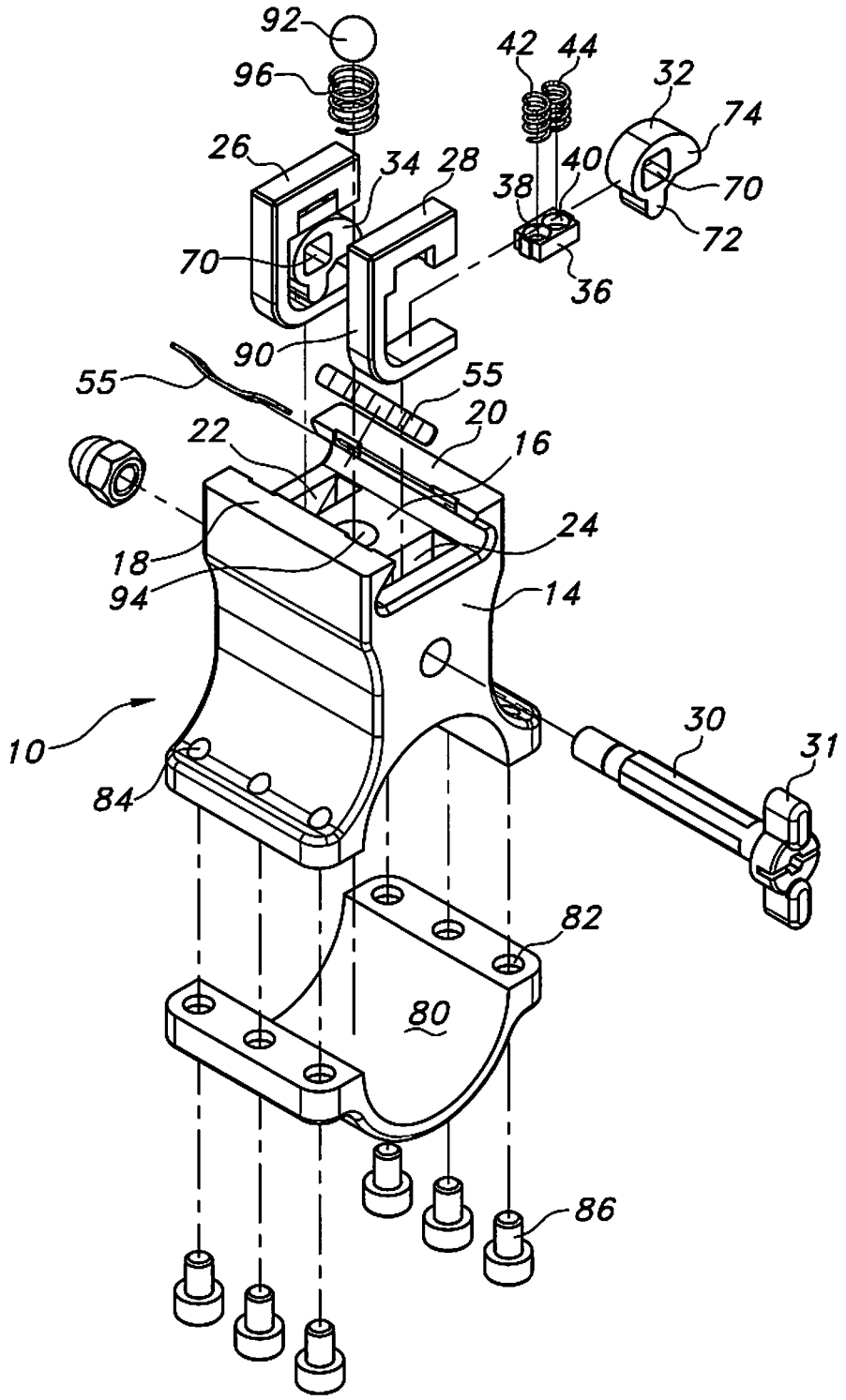
FIG. 2 is an inverted exploded view thereof.

Referring to FIG. 2, each cam 32 has at least one and preferably two cam lobes. In the embodiment illustrated, each cam 32 has a central keyhole 70 dimensioned to closely fit onto the peripheral shape of the shaft of control screw 30. First cam lobe 72 is arrayed at approximately ninety degrees from a second cam lobe 74. First cam lobe 72 has a longer duration gradually ramping up to its maximum lift. First cam lobe 72 provides a lifting or locking action and bears against cam following block 36 forcing cam following block 36 upwardly and forcing the bolt upwardly as well. Second cam lobe 74 provides a positive lowering or unlocking action when bearing against the lower substantially planar portion of the J-shaped lower portion of each bolt. Second cam lobe 74 has a shorter duration with abrupt, symmetrical shoulders.

Each bolt, 26, 28 has a substantially planar upper surface actuating arm 90 extending downwardly below the bolt skirt depth. Actuating arm 90 is substantially rectangular in cross section to slidably receive cam following block 36.

Each cam 32 bears on cam-following spring retaining block 36 which includes first and second vertical blind bores 38, 40 containing first and second biasing coil springs 42, 44.

Control screw 30 has a T-shaped distal handle 31. The control screw distal end includes a slot and a hex socket for actuation by either a screw driver or a hexagonal wrench. Control screw 30 preferably has a central shank portion having a key-shaped cross section adapted to carry and drive the first and second cams 32.

When control screw 30 is turned counterclockwise in its longitudinal bore within yoke 14, each cam 32, 34 is rotated and its respective spring retaining block 36 is simultaneously urged upward to simultaneously force both bolts 26, 28 into an upwardly projecting actuated or locked position.

When control screw 30 is turned clockwise, each cam 32, 34 is rotated into a position tending to simultaneously positively force the bolts downwardly by acting on bolt actuating arm 90 to lower the bolts 26, 28 such that the bolt's upper surfaces do not project above the yoke base plate's central upper surface 16.

In use, bolts 26, 28 are initially in the unlocked, down or retracted position, such that neither bolt projects above the yoke base plate's central upper surface 16. To install the clamp assembly 10 on support rail 50, the user slides the clamp assembly's yoke 14 over the free distal or proximal end of rail 50 and over successive ribs 98. When yoke 14 is situated at the desired position on rail 50, the user receives a tactile indication that yoke 14 is correctly positioned by the action of positioning ball 92 dropping into the associated groove 100 by the biasing action of spring 96. By this means, bolts 26, 28 are perfectly aligned with respective grooves 100 of mounting rail 50. Following this, control screw 30 is manually rotated to simultaneously rotate cams 32, 34 forcing bolts 26, 28 to be raised to the closed and locked positions whereupon bolts 26, 28 are received in and constrained by the spaced apart transverse grooves of support rail 50 to fixedly attach yoke 14 to rail 50.

The resulting attachment of the clamp assembly 10 to the forearm stock provides a quick and easy attachment to the firearm and enables the clamp assembly to mount securely to the forearm stock of the firearm in a stable, secure selected position.

Mounting yoke 14 defines a substantially U-shaped block having inwardly facing opposing V-shaped grooves in vertical sidewalls 18, 20 and is preferably formed from a hardened metal such as steel or similar durable, high-strength material and are spaced apart at a distance sufficient to slidably receive the rail. Bolts 26, 28 function as transverse fasteners and, when in the rail's transverse grooves, provide substantially square cross-section elongate retaining members that are received through clamp body bores 22, 24 in the base plate surface 16 of mounting yoke 14 and through the aligned transverse grooves 100 of the picatinny rail.

Figure 3:
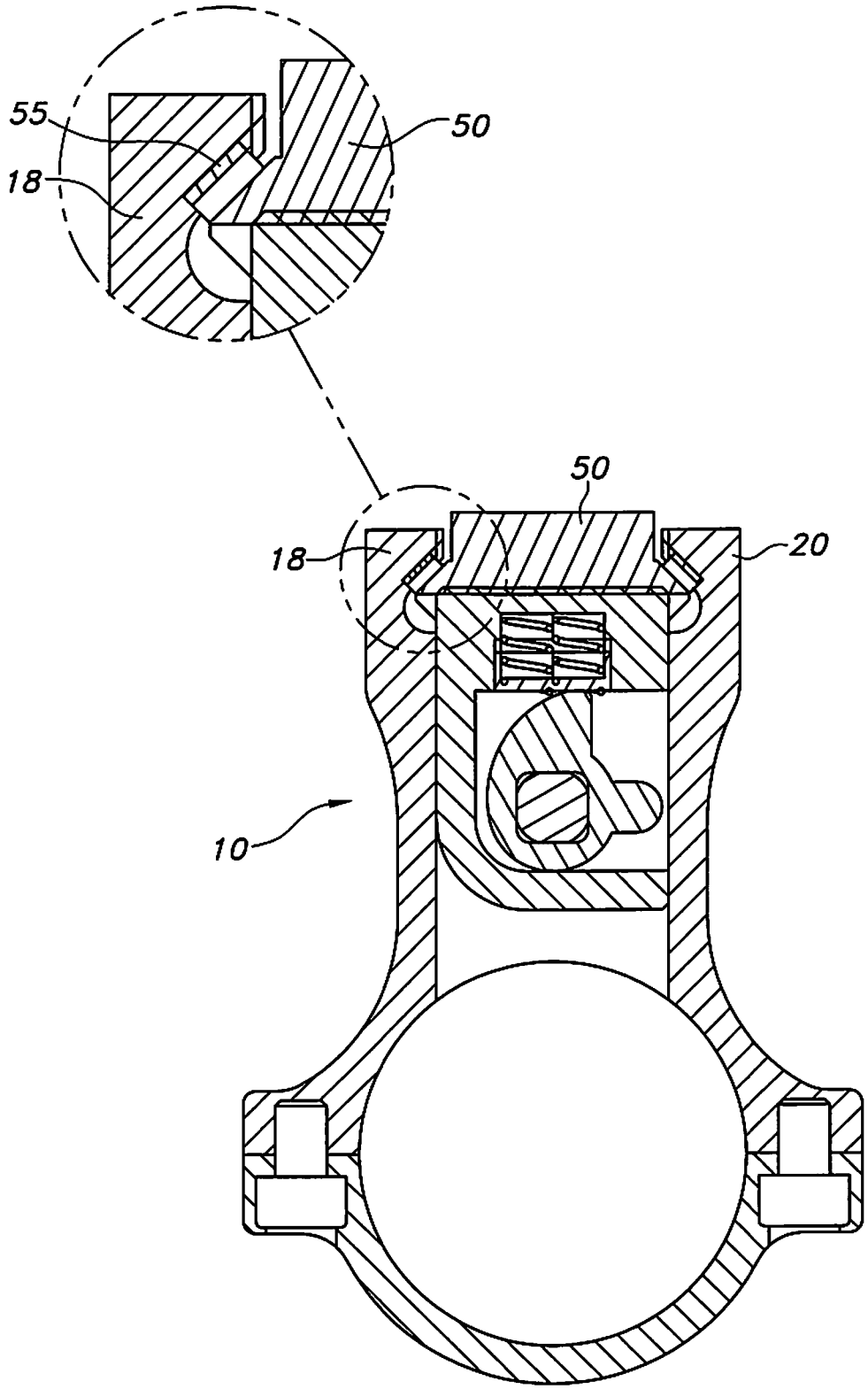
FIG. 3 is an enlarged cross-section view.
Figure 3A:
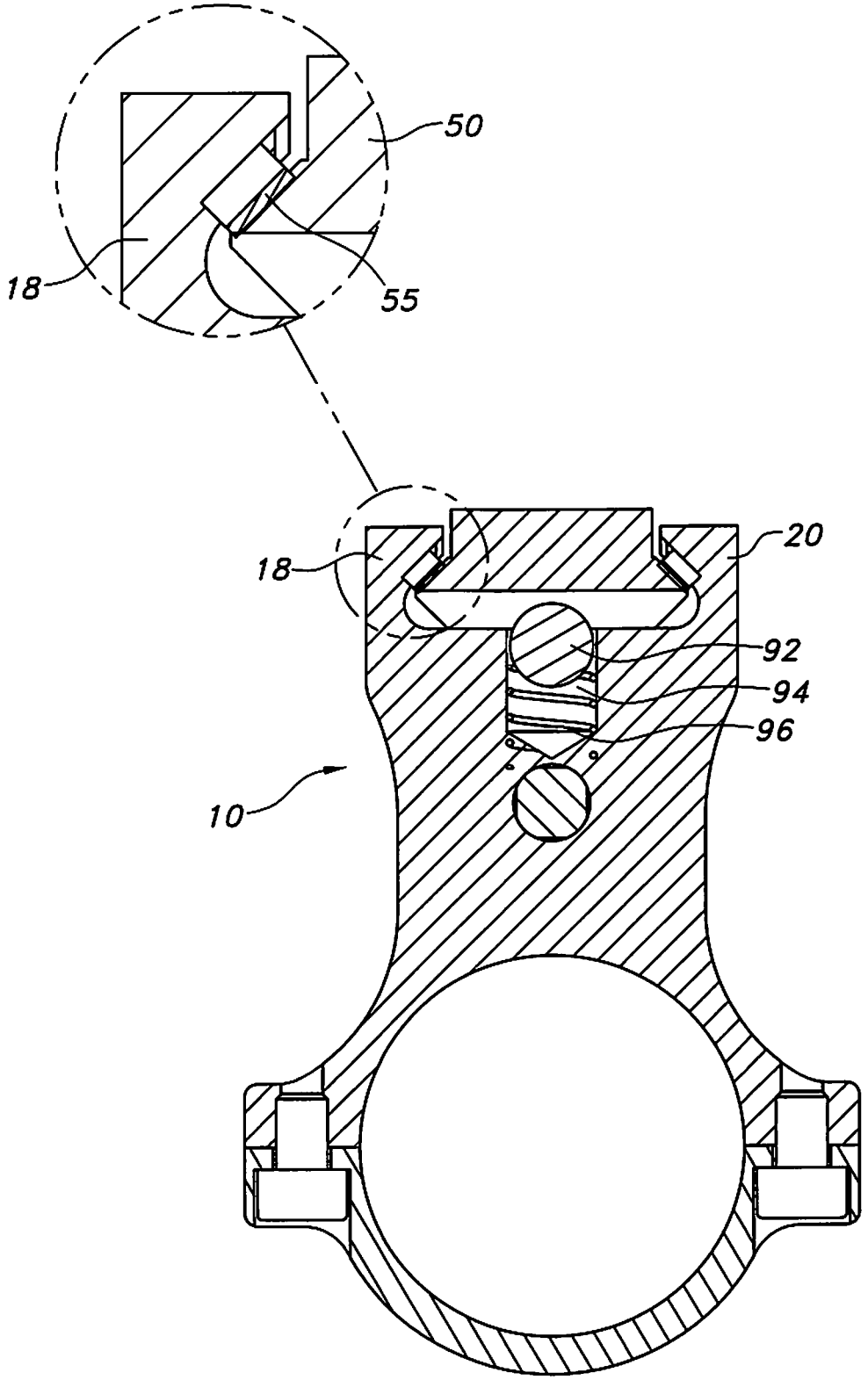
FIG. 3A is an enlarged cross-section view.
Figure 4:
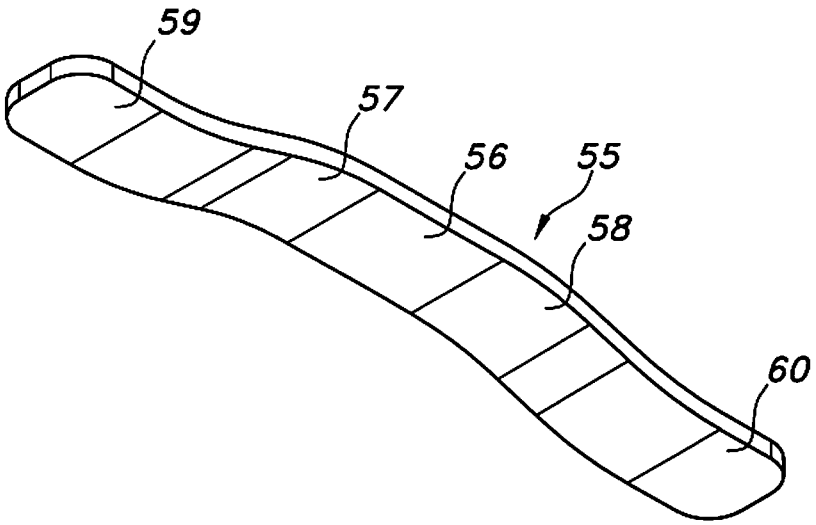
FIG. 4 is an enlarged perspective view of the spring feature of the invention.
Figure 6:
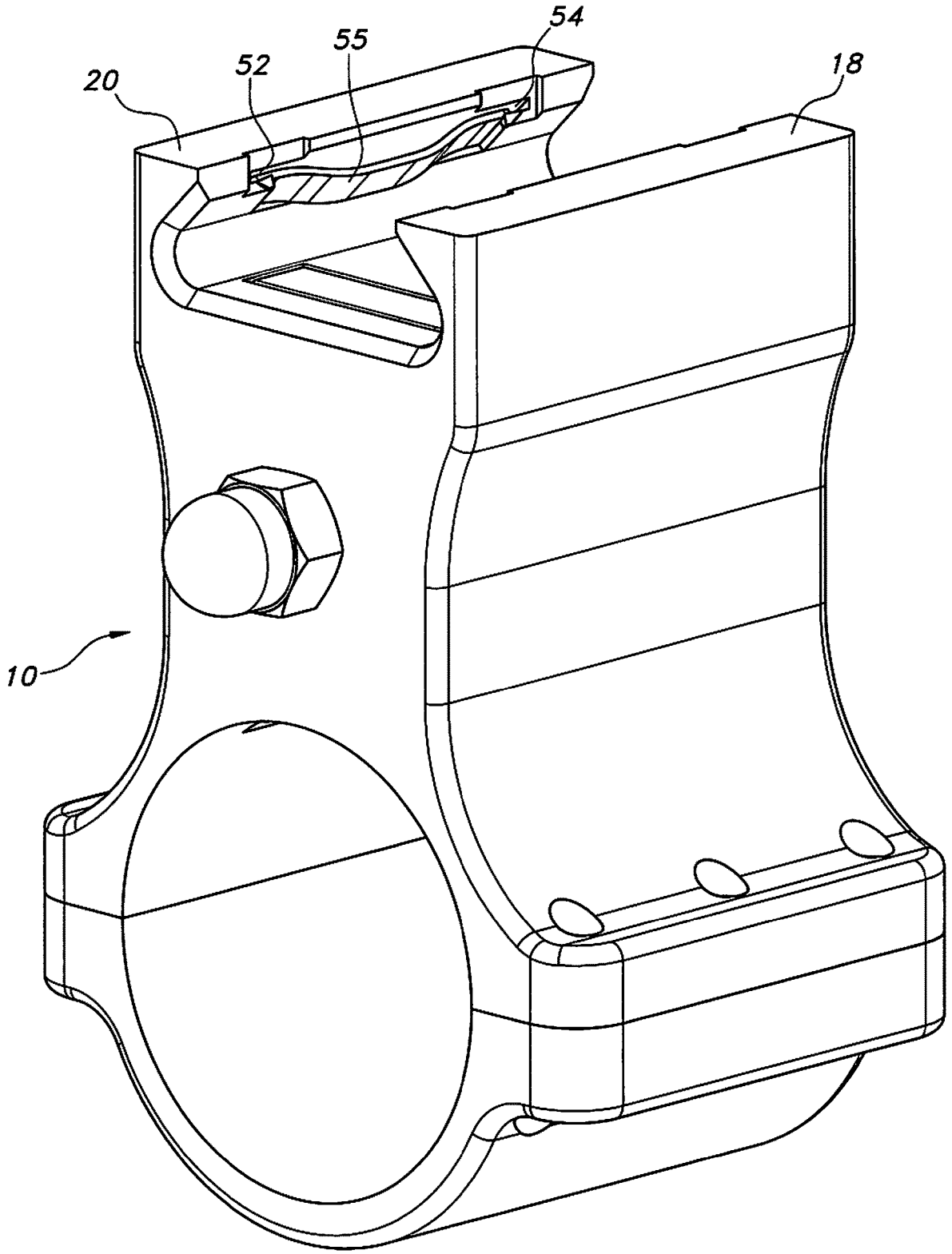
FIG. 6 is an enlarged perspective view depicting details of the spring feature of the invention.
Figure 7:
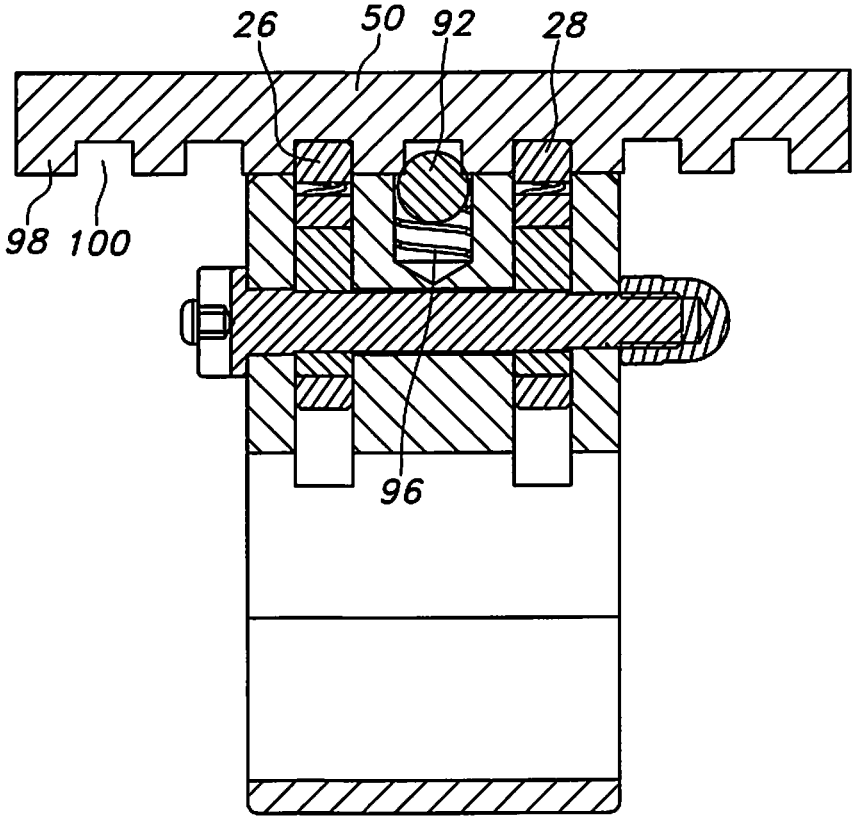
FIG. 7 is a cross-section view showing the positioning ball feature.

Formed on the inwardly facing surfaces of each sidewall 18, 20 are a pair of spaced slots 52, 54, best shown in FIG. 6. Slots 52, 54 are adapted to receive the spaced ends 59, 60 of spring 55. Spring 55 is of an irregular configuration and includes middle section 56 with sloping sections 57, 58 extending outwardly from middle section 56. Further, ends 59, 60 are joined, respectively, to the edges of sloping sections 57, 58 remote from middle section 56. As best shown in FIG. 6, springs 55 are inserted into each inner wall of respective vertical sidewalls 18, 20 whereby ends 59, 60 are inserted, respectively, into slots 52, 54 and frictionally held in position whereby middle section 56 extends inwardly of yoke 14. By this means, when clamp assembly 10 is mounted on rail 50, middle section 56 of each spring 55 presses against adjacent rail 50, as best shown in FIGS. 3 and 3A and any movement or wobbling of the mount and clamp assembly relative to rail 50 is prevented.

In order to mount a firearm scope on the clamp and mount, curved plate 80 is provided. Multiple holes 82 are drilled into the sides of plate 80 and are adapted to cooperate with corresponding holes 84 drilled into yoke 14 remote from sidewalls 18, 20. Multiple fasteners 86 are inserted through the respective holes 82, 84 and a scope is positioned between yoke 14 and curved plate 80. Fasteners 86 are tightened to secure the scope in position.

Figure 5:
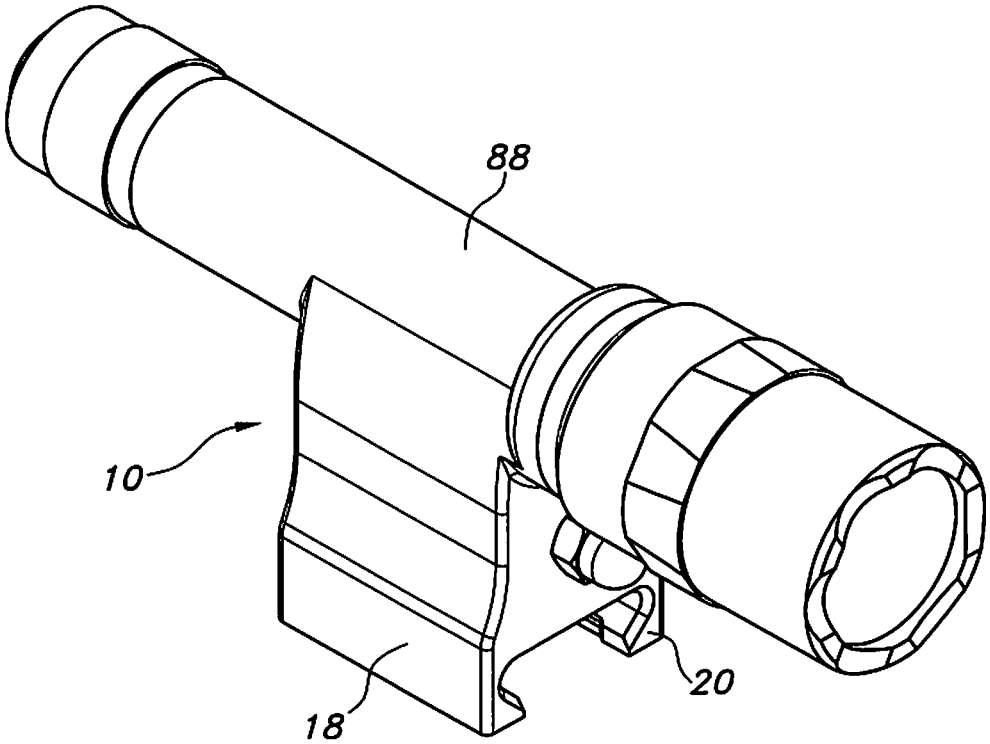
FIG. 5 is a perspective view of an exemplary application of the invention.

Alternatively, as shown in FIG. 5, the lower portion of yoke 14 remote from sidewalls 18, 20 is curved. This allows an accessory such as a flashlight with a diameter sufficient to closely fit in the resilient curved base of yoke 14. In practice, the flashlight is pressed onto yoke 14 and the resilient sides of the yoke base clamp around the flashlight.

In use, to quickly attach the clamp assembly, the user first twists control screw 30 by means of handle 31 to lower the bolts 26, 28 and then slides yoke 14 over the proximal or distal end of the mounting rail and slides yoke 14 into a selected fore/aft position, aligning a selected support rail transverse groove with bolts 26, 28. The bolts may then be raised or locked into engagement with the receiving transverse grooves 100 defined in the picatinny rail to secure the picatinny rail within the yoke 14. To quickly and easily release the clamp assembly, the user then twists the control screw handle to lower the bolts 26, 28 into a disengaged or unlocked position and then slides yoke 14 over and beyond the proximal or distal end of the mounting rail.

The invention claimed is:

1. An accessory mount adapted for releasable attachment to an elongated rail having V-shaped sides and a plurality of evenly spaced transverse grooves comprising:

a clamp body with a mounting yoke that is adapted to slide over and receive the opposing V-shaped sides of said rail;

said yoke including a substantially rectangular base plate surface defining a central upper surface of said clamp body and including a pair of spaced parallel sidewalls extending upwardly therefrom;

a bore formed in said yoke and having an opening in said central upper surface;

a spring disposed in said bore; and a positioning ball partially disposed in said bore and biased upwardly by means of said spring.

2. The accessory mount according to claim 1 wherein said positioning ball is disposed in one of said grooves.

3. The accessory mount according to claim 2 wherein a pair of bolts are extendable upwardly from said central upper surface.

4. The accessory mount according to claim 3 wherein a pair of bolts are disposed respectively on opposite sides of said positioning ball and in the respective one of said grooves.

* * * * *